US007493062B2

(12) United States Patent
Igarashi

(10) Patent No.: US 7,493,062 B2
(45) Date of Patent: Feb. 17, 2009

(54) IMAGE-FORMING DEVICE HAVING SWITCHBACK CONVEYING PATH

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 318 days.

(21) Appl. No.: 11/377,346

(22) Filed: Mar. 17, 2006

(65) Prior Publication Data

US 2006/0220309 A1 Oct. 5, 2006

(30) Foreign Application Priority Data

Mar. 17, 2005 (JP) ..... 2005-077567

(51) Int. Cl.
*G03G 21/18* (2006.01)
*G03G 15/01* (2006.01)
*G03G 15/00* (2006.01)

(52) U.S. Cl. ..... 399/111; 399/299; 399/405

(58) Field of Classification Search ..... 399/111, 399/298, 299, 302, 303, 405
See application file for complete search history.

(56) References Cited

U.S. PATENT DOCUMENTS

| | | | | |
|---|---|---|---|---|
| 5,842,095 | A * | 11/1998 | Kitamura | 399/299 |
| 6,445,899 | B2 * | 9/2002 | Sato | 399/299 |
| 6,798,430 | B2 * | 9/2004 | Sato | 399/299 |
| 7,039,339 | B2 * | 5/2006 | Yokomori et al. | 399/111 |
| 7,343,124 | B2 * | 3/2008 | Uehara | 399/299 |

FOREIGN PATENT DOCUMENTS

| | | |
|---|---|---|
| JP | 3288166 | 12/1991 |
| JP | 6161185 | 6/1994 |
| JP | 973258 | 3/1997 |
| JP | 11292369 | 10/1999 |
| JP | 2003186348 | 7/2003 |
| JP | 2005-024699 A | 1/2005 |

OTHER PUBLICATIONS

State Intellectual Property Office, Notification of the First Office Action in Chinese Patent Appl'n No. 2006100585491 (counterpart to the above-captioned U.S. patent application), mailed Mar. 14, 2008.

* cited by examiner

*Primary Examiner*—William J Royer
(74) *Attorney, Agent, or Firm*—Baker Botts L.L.P.

(57) ABSTRACT

An image-forming device includes: a main device body; a plurality of process cartridges; a fixing unit; a tray; a switchback conveying path; and a reverse conveying unit. The plurality of process cartridges are detachably mounted in the main device body. The process cartridges are arranged in a row in the main device body when the process cartridges are mounted in the main device body. Each process cartridge has an image-carrying member that transfers a developer image carried thereon to a sheet by opposing the sheet. The fixing unit is provided in the main device body and fixes the developer image to the sheet after the image has been transferred thereto. The tray is provided in the main device body and supports the sheet after the developer image has been fixed thereon. The switchback conveying path is provided in the main device body and guides the sheet from the fixing unit to the tray, while switching a conveying direction of the sheet. The reverse conveying unit is disposed in the main device body along the switchback conveying path and reverses the conveying direction of the sheet.

12 Claims, 9 Drawing Sheets

IMAGE-FORMING DEVICE HAVING SWITCHBACK CONVEYING PATH

CROSS REFERENCE TO RELATED APPLICATION

This application claims priority from Japanese Patent Application No. 2005-77567 filed Mar. 17, 2005. The entire content of this priority application is incorporated herein by reference.

TECHNICAL FIELD

The disclosure relates to an image-forming device, and particularly to a tandem type image-forming device.

BACKGROUND

A vertical tandem type laser printer is disclosed in Japanese unexamined patent application publication No. 2003-186348. The vertical tandem type laser printer is one type of electrophotographic image-forming device.

SUMMARY

FIGS. 1 and 2 show the structure of a conceivable laser printer of the vertical tandem type.

As shown in FIGS. 1 and 2, the conceivable laser printer 100 includes four process cartridges 103 to correspond to the four colors used in image formation. Each process cartridge 103 has a photosensitive drum 101 and a toner-accommodating section 102. The process cartridges 103 are accommodated in a main device body 104 of the laser printer 100 so as to be stacked vertically.

The laser printer 100 further includes a paper cassette 105 disposed in a lower section of the main device body 104 for accommodating a paper 106, and a conveying belt 107 disposed in a front section of the main device body 104 for conveying the paper 106 supplied from the paper cassette 105 in an upward direction. The process cartridges 103 are disposed so that the photosensitive drums 101 oppose the conveying belt 107. The conveying belt 107 is retained in a cover 108 disposed on the front surface of the main device body 104 that is capable of opening and closing on the front surface. By opening the cover 108 together with the conveying belt 107 as shown in FIG. 2, the process cartridges 103 are exposed, enabling the user to replace the process cartridges 103, resolve paper jams, and the like. An exposure device 109 for irradiating light on the photosensitive drums 101 is disposed on the rear side of the process cartridges 103. The laser printer 100 further includes a fixing unit 110 and a discharge tray 111 disposed in a top section of the main device body 104.

With this construction, after the paper 106 conveyed upward along the conveying belt 107 passes through the fixing unit 110, the paper 106 curves toward the rear side of the main device body 104 to be discharged onto the discharge tray 111.

However, since the laser printer 100 described above discharges the paper 106 toward the rear of the main device body 104, it is difficult to retrieve the paper 106 after image formation. Retrieving the paper 106 becomes increasingly difficult when an original-reading unit is mounted on top of the discharge tray 111. While it is conceivable to provide the discharge tray 111 on the front side of the fixing unit 110 so that the paper 106 curves toward the front to be discharged after passing through the fixing unit 110, this configuration discharges the paper 106 onto the discharge tray 111 with the image formation surface face up. As a result, the order of pages is reversed when printing a plurality of sheets consecutively. Furthermore, the discharge tray 111 extends forward from the front of the device in this case, increasing the depth dimension of the overall image-forming device.

As described above, the conceivable laser printer of the vertical tandem type suffers from various problems due to restrictions in the layout of the device related to paper conveyance.

In view of the foregoing, it is an object of the invention to provide an image-forming device capable of resolving the various problems described above by increasing the amount of freedom in layout design related to paper conveyance.

In order to attain the above and other objects, the invention provides an image-forming device including: a main device body; a plurality of process cartridges; a fixing unit; a tray; a switchback conveying path; and a reverse conveying unit. The plurality of process cartridges are detachably mounted in the main device body. The process cartridges are arranged in a row in the main device body when the process cartridges are mounted in the main device body. Each process cartridge has an image-carrying member that transfers a developer image carried thereon to a sheet by opposing the sheet. The fixing unit is provided in the main device body and fixes the developer image to the sheet after the image has been transferred thereto. The tray is provided in the main device body and supports the sheet after the developer image has been fixed thereon. The switchback conveying path is provided in the main device body and guides the sheet from the fixing unit to the tray, while switching a conveying direction of the sheet. The reverse conveying unit is disposed in the main device body along the switchback conveying path and reverses the conveying direction of the sheet.

DETAILED DESCRIPTION

A vertical tandem type color laser printer according to an illustrative aspect of the invention will be described with reference to FIGS. 3 and 4.

Figure 1:
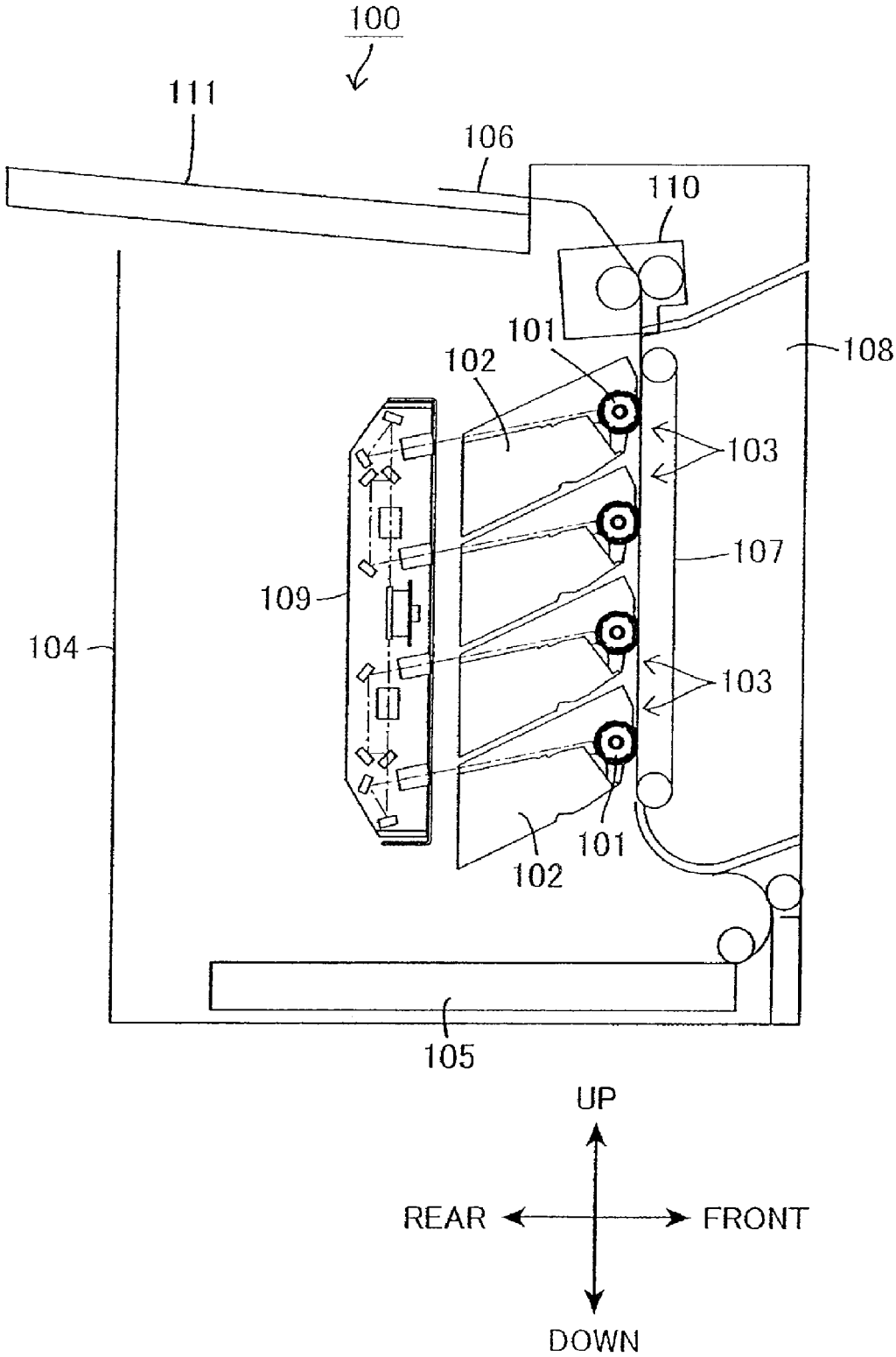
FIG. 1 Related Art
FIG. 1 is a cross-sectional view of a conceivable laser printer when a cover is closed thereon.
Figure 2:
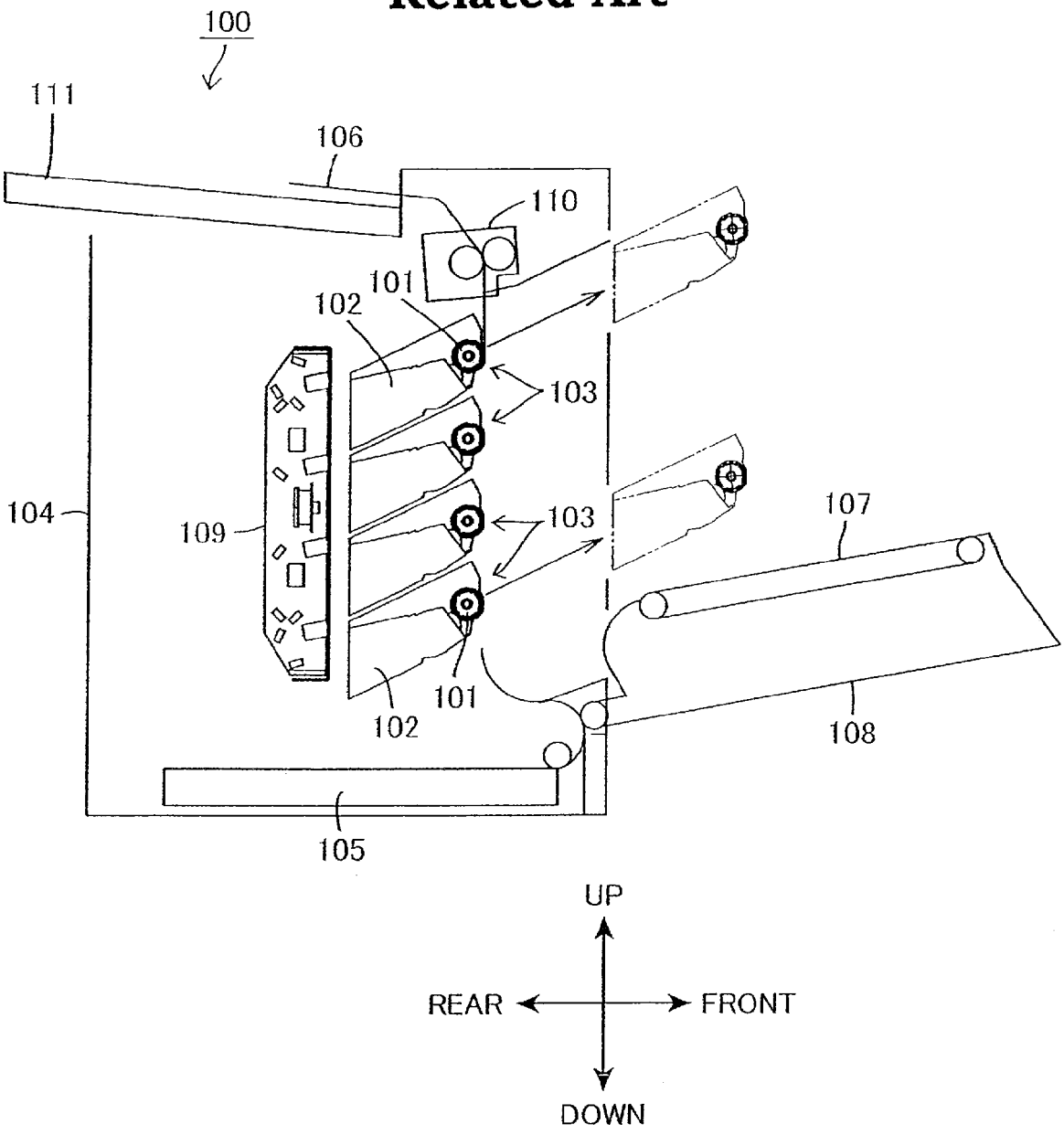
FIG. 2 Related Art
FIG. 2 is a cross-sectional view of the conceivable laser printer in FIG. 1 when the cover is open.
Figure 3:
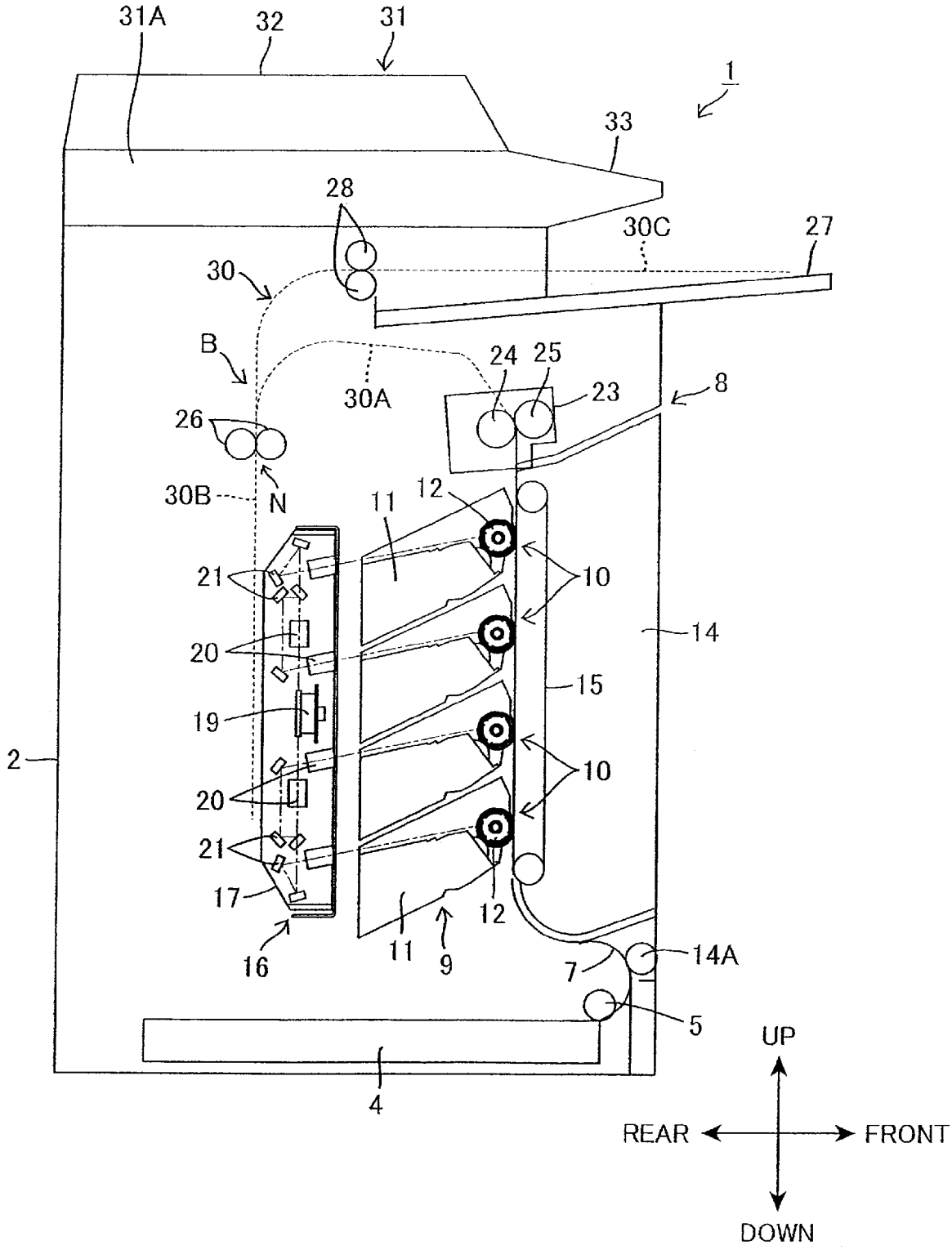
FIG. 3 is a cross-sectional view of a laser printer according to one illustrative aspect of the invention when a cover is closed thereon.
Figure 4:
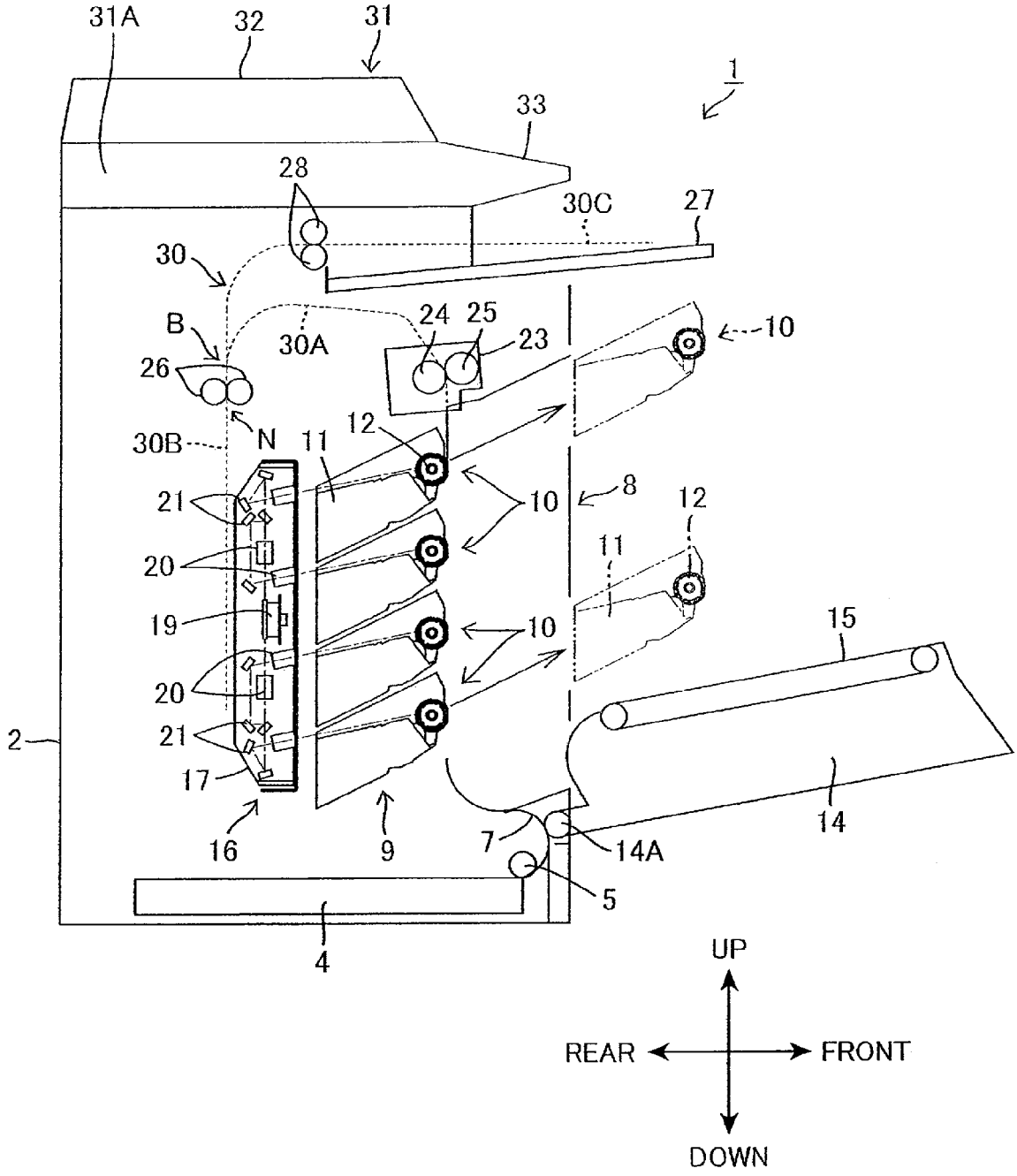
FIG. 4 is a cross-sectional view of the laser printer in FIG. 3 when the cover is open.
Figure 5B:
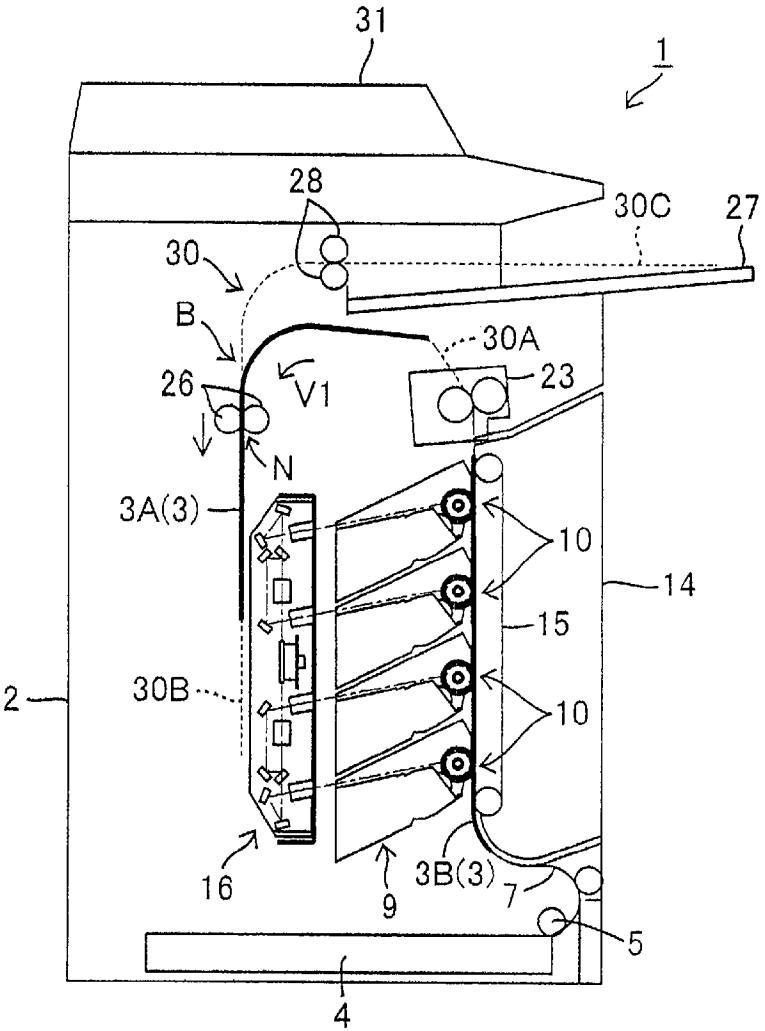
FIGS. 5(*a*) through 5(*g*) are cross-sectional views illustrating successive steps in a continuous printing process of the laser printer.
Figure 5A:
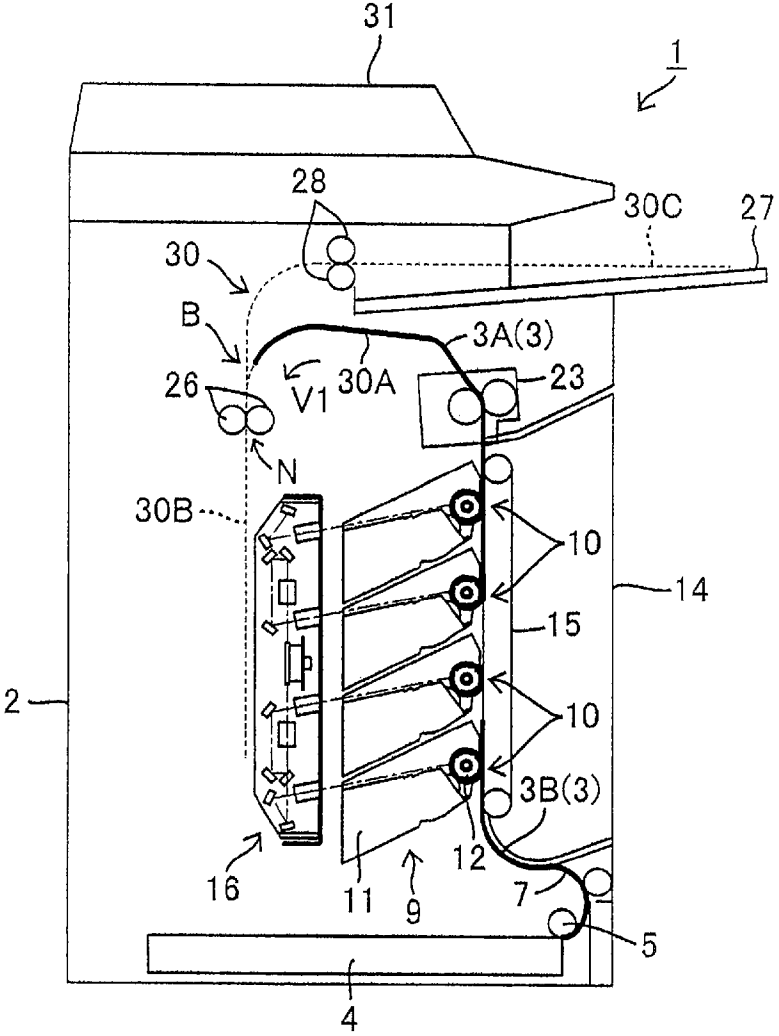
Figure 5D:
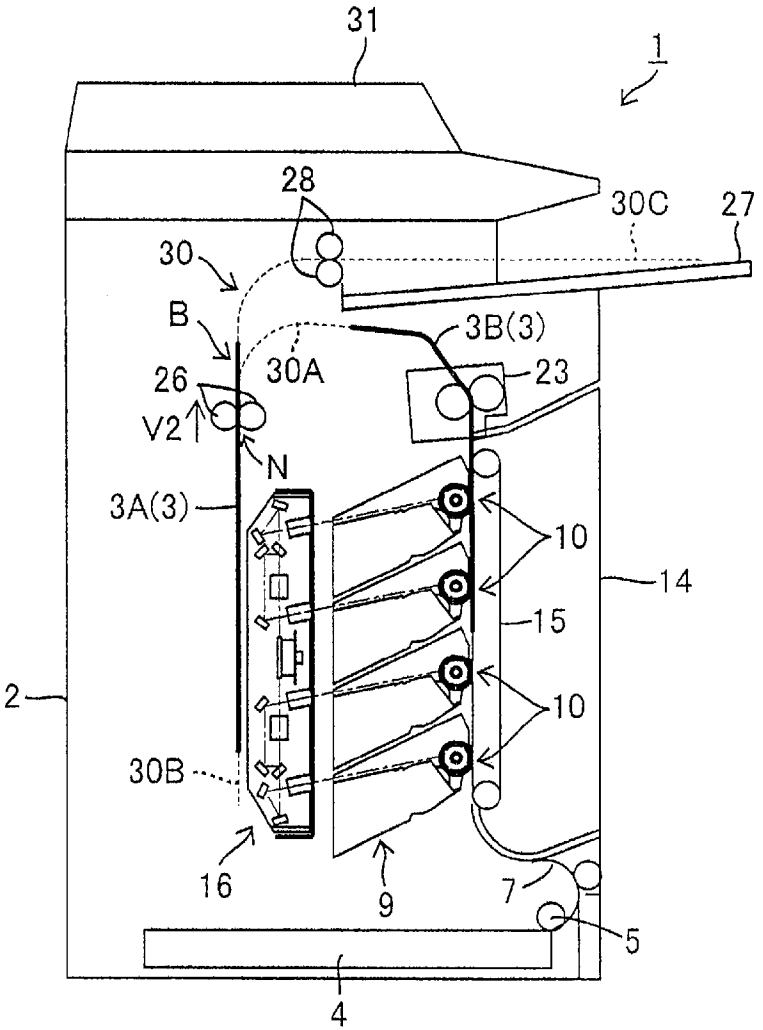
Figure 5C:
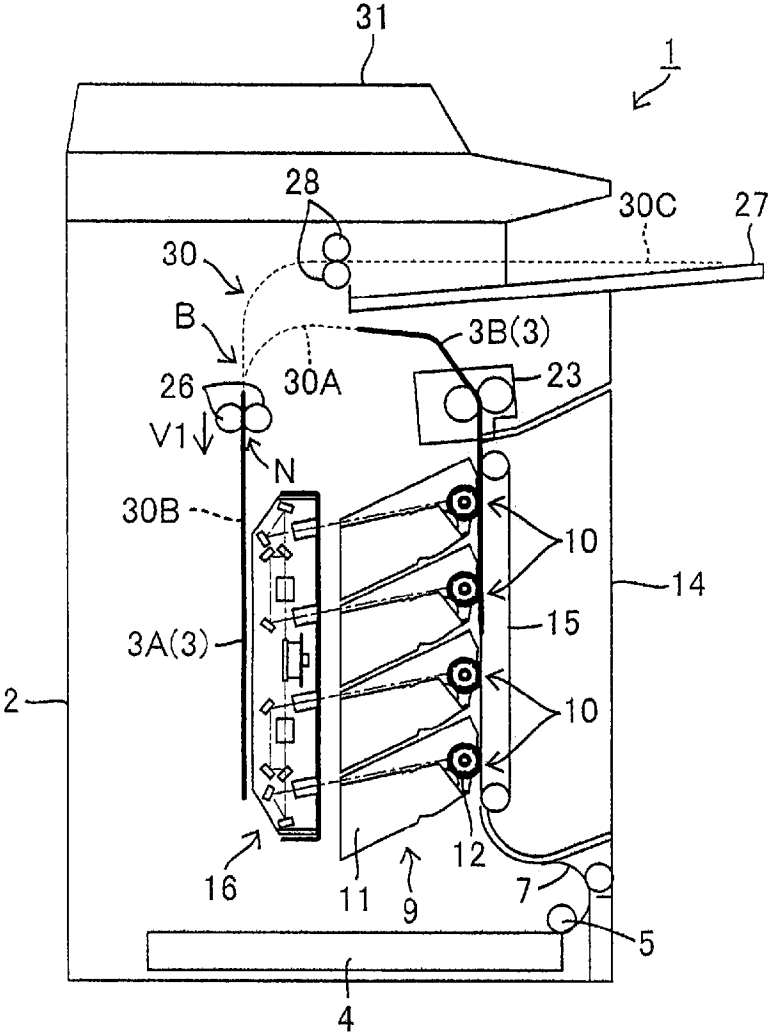
Figure 5F:
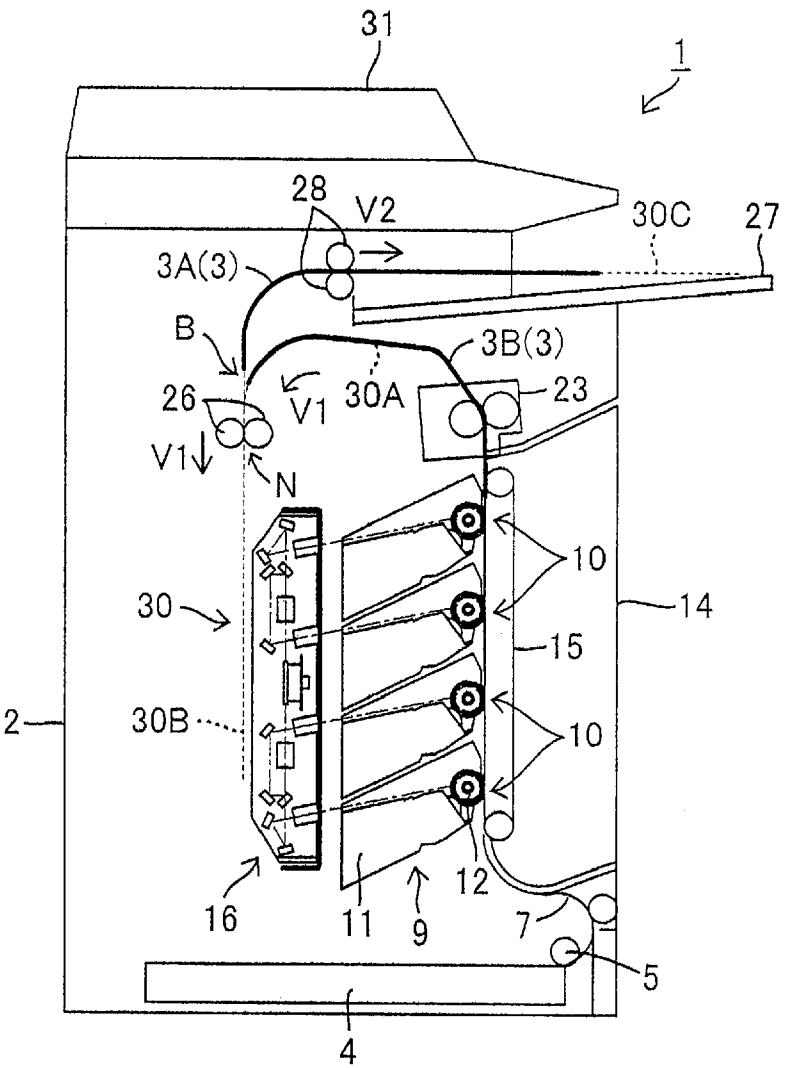
Figure 5E:
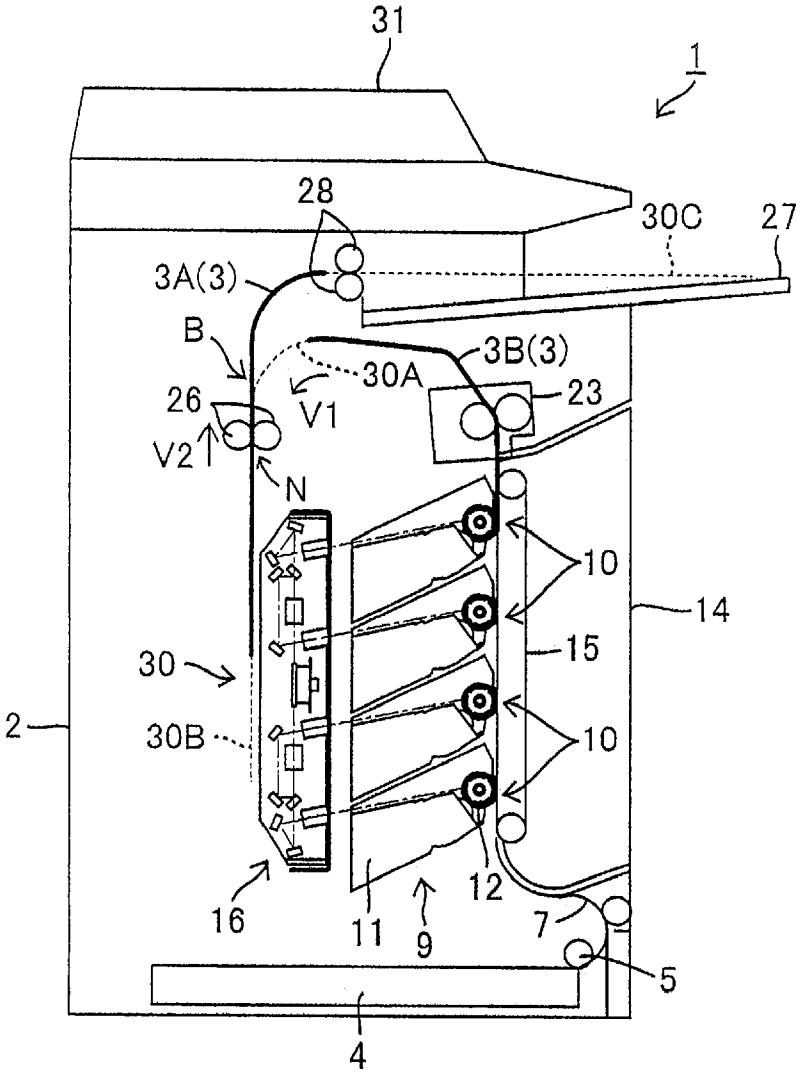
Figure 5G:
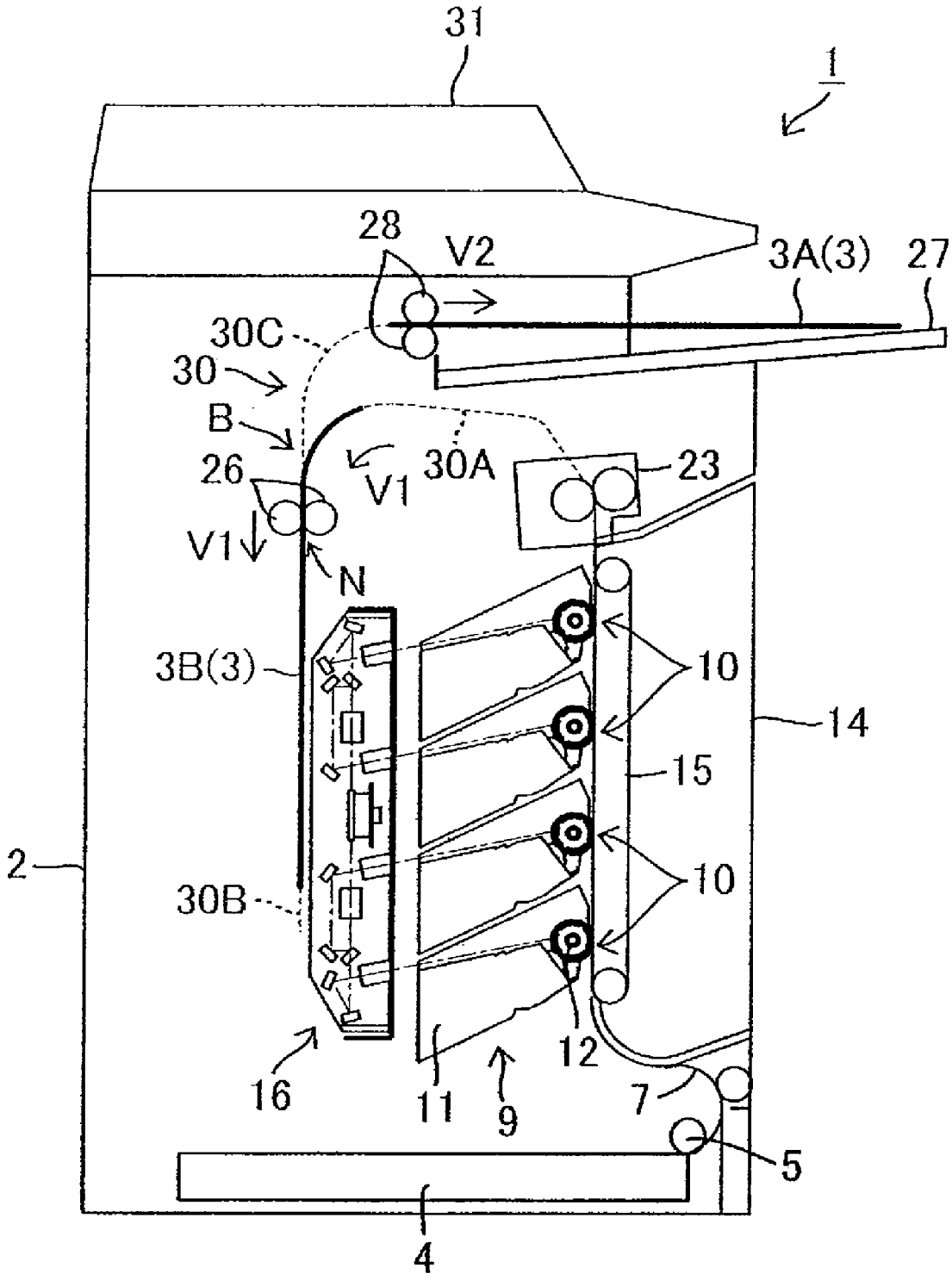

FIGS. 3 and 4 show a general structure of a laser printer 1 according to this aspect. FIG. 3 shows the laser printer 1 when a cover 14 is in a closed state, while FIG. 4 shows the laser printer 1 when the cover 14 is in an open state. The terms "upward", "downward", "upper", "lower", "above", "below", "beneath", "front", "rear", "right", and "left" and the like will be used throughout the description assuming that the laser printer 1 is disposed in an orientation in which it is intended to be used. In use, the laser printer 1 is disposed as shown in FIG. 3.

As shown in the drawings, the laser printer 1 includes a main casing 2; a paper cassette 4 disposed in a bottom section of the main casing 2 for accommodating sheets of a paper or other recording medium 3 in a stacked state, the paper cassette 4 capable of being pulled out of the main casing 2 in a forward direction; a feeding roller 5 disposed above a front end of the paper cassette 4 for conveying the paper 3 upward; and a feeding path 7 formed above the feeding roller 5 along which the paper 3 is conveyed by the feeding roller 5. Although not shown in detail in the drawings, a paper sensor is disposed along the feeding path 7 for detecting the leading edge and trailing edge of the paper 3. Based on these detection results, it is possible to determine the length and the like of the paper 3.

An access opening 8 is formed in the front surface of the main casing 2. A cartridge-accommodating section 9 is formed inside the main casing 2 to the rear of the access opening 8. Four process cartridges 10 corresponding to the colors black, cyan, magenta, and yellow are mounted in the cartridge-accommodating section 9 of the main casing 2 in a vertically stacked arrangement. More specifically, the process cartridges 10 are stacked in a slanted direction so as to be positioned progressively rearward from bottom to top.

Each of the process cartridges 10 includes a toner-accommodating section 11 having a box shape for accommodating a toner, a photosensitive drum 12 on which an electrostatic latent image is formed, and a developing device (not shown) for developing the electrostatic latent image formed on the photosensitive drum 12 into a visible image with toner. Each process cartridge 10 is mounted in the cartridge-accommodating section 9 so that the photosensitive drum 12 faces the access opening side and the toner-accommodating section 11 faces the rear side.

The cover 14 is disposed on the front surface of the main casing 2 and is capable of opening and closing over the access opening 8. In general, the cover 14 has a thick plate-shape with a shaft part 14A provided on the lower end thereof. The shaft part 14A is attached to the main casing 2 near the lower edge of the access opening 8 so that the cover 14 can rotate about the shaft part 14A. The cover 14 can be moved between a closed position shown in FIG. 3 in which the cover 14 covers the access opening 8, and an open position shown in FIG. 4 in which the cover 14 is rotated down from the front side of the main casing 2 so that the access opening 8 is exposed.

An endless conveying belt 15 is extended along the inner surface of the cover 14 and has a vertical orientation when the cover 14 is in the closed position. The conveying belt 15 conveys the paper 3 fed by the feeding roller 5 along the feeding path 7 upward so that one surface of the paper 3 (the surface facing rearward) sequentially opposes each of the photosensitive drums 12. Transfer rollers 13 (shown in FIG. 6, but omitted from the other drawings) are provided on the inside of the conveying belt 15 for opposing each of the photosensitive drums 12 and applying a transfer bias therebetween. As a result, of the transfer bias applied by the transfer rollers 13, toner images formed on the photosensitive drums 12 are sequentially transferred onto the paper 3.

When the cover 14 is opened, the conveying belt 15 is displaced forward together with the cover 14, exposing the front side of the photosensitive drums 12. At this time, it is possible to mount or remove the process cartridges 10 via the access opening 8. Further, opening the cover 14 facilitates operations for resolving paper jams and the like.

An exposure device 16 is provided in the main casing 2 on the rear side of the cartridge-accommodating section 9. The exposure device 16 includes a case 17 within which are provided laser light-emitting units (not shown), a polygon mirror 19 that is driven to rotate, various lenses 20 and reflecting mirrors 21, and the like. As illustrated by the broken line in FIG. 3, the laser light-emitting units of the exposure device 16 emit laser beams based on image data for each color, and the laser beams are irradiated onto the surfaces of the respective photosensitive drums 12, forming electrostatic latent images thereon.

A fixing unit 23 is disposed in the main casing 2 above the conveying belt 15 when the cover 14 is in the closed position. The fixing unit 23 includes a heating roller 24 and a pressure roller 25 for fixing a toner image transferred onto the paper 3 to the surface of the paper 3 with heat while conveying the paper 3 downstream. A pair of reverse-conveying rollers 26 capable of rotating in both forward and reverse directions is disposed in the main casing 2 rearward of the fixing unit 23, A discharge tray 27 is also provided in the main casing 2 above the fixing unit 23 for receiving the paper 3 after image formation. The discharge tray 27 extends toward the front of the main casing 2 and slopes slightly upward toward the front edge. A pair of discharge rollers 28 are disposed near the rear edge of the discharge tray 27 for conveying the paper 3 onto the discharge tray 27.

A switchback conveying path 30 (indicated by a dotted line in FIGS. 3 and 4) is formed in the laser printer 1 for guiding the paper 3 conveyed from the fixing unit 23 to the discharge tray 27 after reversing directions. As will be described below, the switchback conveying path 30 includes an advancing path 30A, a paper-retracting section 30B, and a discharging path 30C.

The advancing path 30A leads from a nip position between the heating roller 24 and pressure roller 25 in the fixing unit 23 to a nip point N between the reverse-conveying rollers 26 and substantially describes an arc shape with the curve of the arc on the top side. The paper-retracting section 30B extends vertically downward from the nip point N of the reverse-conveying rollers 26. The paper-retracting section 30B is a slit-shaped space provided in the main casing 2 on the rear side of the exposure device 16 in which the paper 3 can be temporarily received when switching directions. The discharging path 30C extends upward from the nip point N of the reverse-conveying rollers 26, sharing the same path with the advancing path 30A up to a branch point B. At the branch point B, the advancing path 30A branches off of the discharging path 30C in a direction sloping upward and forward, while the discharging path 30C continues upward from the branch point B, curves forward toward the discharge rollers 28 at the top of the main casing 2, and continues onto the discharge tray 27.

An original-reading unit 31 is disposed above the discharge tray 27 so as to cover a part of the same. The original-reading unit 31 is a flatbed scanner configured of a main body 31A, and an automatic document feeder (ADF) 32 disposed above the main body 31A. The user lifts the ADF 32 upward to expose a document-supporting surface formed on top of the main body 31A. The original-reading unit 31 can read images from various documents placed on top of the document-supporting surface. A control panel 33 is also disposed on a top surface of the main body 31A that protrudes forward from the ADF 32. The control panel 33 enables the user to specify various operations to perform with the laser printer 1. The main body 31A of the original-reading unit 31 is fixed to the main casing 2 and cannot be withdrawn from a position above the discharge tray 27.

Next, operations of the laser printer 1 during continuous printing will be described. FIGS. 5(*a*) through 5(*g*) illustrate multiple stages in a continuous printing operation performed by the laser printer 1. In the following description, it will be necessary to differentiate one sheet of the paper 3 from a sheet conveyed after this sheet. Hence, these sheets will be referred to as a first sheet 3A and a second sheet 3B, respectively.

When the laser printer 1 begins the continuous printing operation, the feeding roller 5 feeds the first sheet 3A from the paper cassette 4 to the conveying belt 15 via the feeding path 7. As the conveying belt 15 conveys the first sheet 3A upward, toner in each color is sequentially transferred from each photosensitive drum 12 onto the first sheet 3A. Subsequently, the first sheet 3A is conveyed through the fixing unit 23, at which time the toner image on the first sheet 3A is fixed to the first sheet 3A by heat. In this example, the paper 3 is conveyed at a constant velocity by the conveying belt 15 and fixing unit 23. This constant velocity will be denoted as V1 (mm/sec). In the meantime, while the first sheet 3A is being conveyed by the conveying belt 15, the feeding roller 5 feeds the second sheet 3B at a prescribed timing. The prescribed timing is set such that a gap G (mm) is formed between the trailing edge of the first sheet 3A and the leading edge of the second sheet 3B.

As the first sheet 3A passes through the fixing unit 23, the advancing path 30A of the switchback conveying path 30 guides the leading edge of the first sheet 3A rearward (see FIG. 5(*a*)). Before the leading edge of the first sheet 3A reaches the nip point N between the reverse-conveying rollers 26, the reverse-conveying rollers 26 are driven to rotate in a forward rotation for conveying the paper 3 downward. The rotational speed of the reverse-conveying rollers 26 on the peripheral surfaces thereof is set to the velocity V1. Therefore, when the leading edge of the first sheet 3A arrives at the nip point N, the first sheet 3A maintains the velocity V1 while being conveyed into the paper-retracting section 30B (see FIG. 5(*b*)).

After the trailing edge of the first sheet 3A subsequently passes the branch point B where the advancing path 30A branches from the discharging path 30C (see FIG. 5(*c*)) and before the trailing edge of the first sheet 3A reaches the nip point N of the reverse-conveying rollers 26, the reverse-conveying rollers 26 begin rotating in reverse. Consequently, the conveying direction of the first sheet 3A is reversed from a downward direction to an upward direction in what is referred to as a switchback operation so that the trailing edge side of the first sheet 3A is conveyed onto the discharging path 30C (see FIG. 5(*d*)). At this time, the rotational speed of the reverse-conveying rollers 26 on the peripheral surface thereof, that is, the conveying velocity of the first sheet 3A in the reverse direction, is set to a conveying velocity V2 (mm/sec). Hence, the first sheet 3A is guided upward and subsequently curved in a forward direction toward the discharge rollers 28 along the discharging path 30C (see FIG. 5(*e*)). The discharge rollers 28 then discharge the first sheet 3A onto the discharge tray 27 at the same velocity V2 (see FIG. 5(*f*)). At this time, the first sheet 3A is discharged with the image formation surface facing downward. By setting the conveying velocity V2 of the first sheet 3A for the reverse direction to a value greater than the velocity V1 of the first sheet 3A prior to reversal, it is possible to reduce the amount of time required to discharge the first sheet 3A after the printing operation is begun.

In the meantime, after the first sheet 3A passes the branch point B, the second sheet 3B arrives at the nip point N between the reverse-conveying rollers 26 and begins the same switchback conveyance operation described for the first sheet 3A (see FIGS. 5(*f*) and 5(*g*)). In other words, the second sheet 3B is guided into the paper-retracting section 30B by the reverse-conveying rollers 26 at the velocity V1 and is subsequently discharged along the discharging path 30C onto the discharge tray 27 at the velocity V2.

Figure 6:
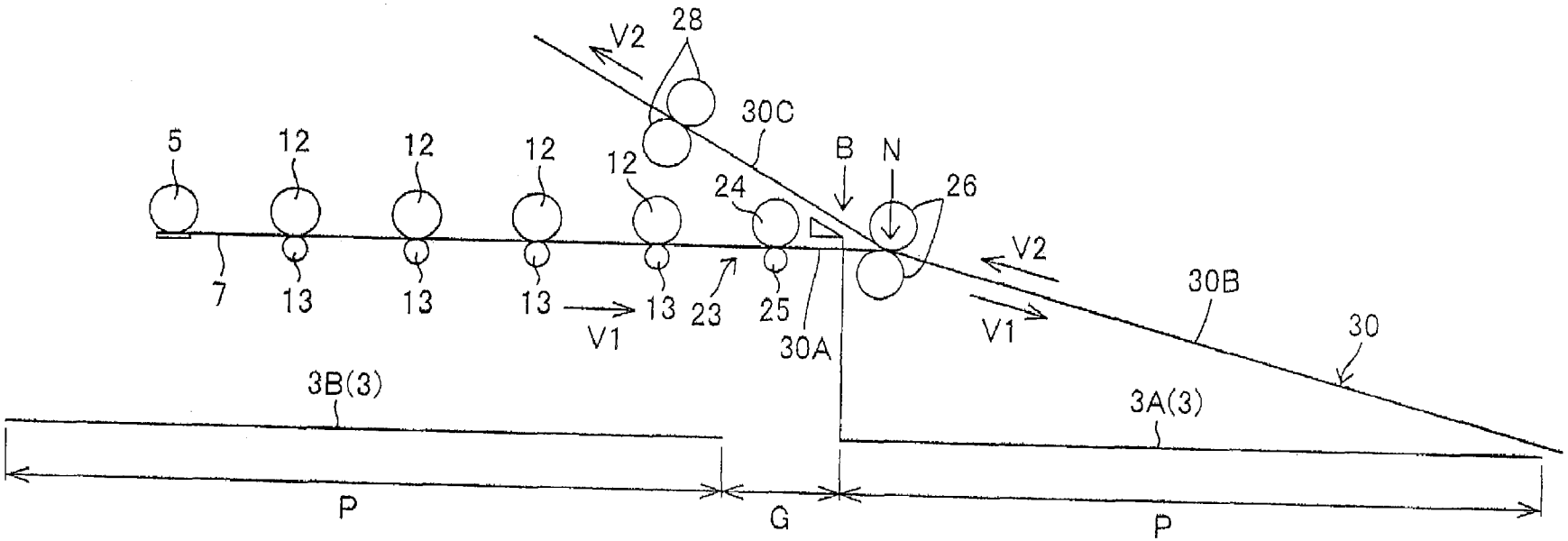
FIG. 6 is an explanatory diagram illustrating a simplified version of a paper-conveying path.

Next, an example of settings for conveying velocities V1 and V2 of the sheets 3A and 3B prior to the switchback and after the switchback, respectively, and for the gap G formed between the first sheet 3A and the second sheet 3B will be described with reference to FIG. 6. FIG. 6 is an explanatory diagram in which the conveying path for the paper 3 has been simplified.

As shown in FIG. 6, the gap G between the trailing edge of the first sheet 3A and the leading edge of the second sheet 3B along the sheet conveying path when the trailing edge of the first sheet 3A arrives at the branch point B is the gap G (mm). Here, P (mm) will denote the length of the sheets 3A and 3B along the sheet conveying direction. From this position, the time required for the leading edge of the first sheet 3A (the edge farthest into the paper-retracting section 30B) to pass the branch point B when conveyed in reverse by the reverse-conveying rollers 26 is P/V2. If this time P/V2 is smaller than a time G/V1 required for the leading edge of the second sheet 3B to reach the branch point B, then the first sheet 3A and second sheet 3B will not interfere with each other. Hence, the following equation can be derived.

$$P/V2 \leqq G/V1 \quad \text{(A)}$$

This can be rewritten as:

$$V1 \cdot P/V2 \leqq G \quad \text{(B)}$$

Hence, it is possible to avoid conflict between the first sheet 3A and second sheet 3B by setting values for the conveying velocities V1 and V2 and the gap G between the first sheet 3A and second sheet 3B to satisfy Equation (B) above. When V1 equals V2, G must be set to satisfy the following equation.

$$P \leqq G \quad \text{(C)}$$

In the vertical tandem type laser printer 1 described above, the paper 3 is guided along the switchback conveying path 30 after an image has been fixed thereon before being discharged onto the discharge tray 27. This configuration increases the layout freedom with respect to the conveyance of the paper 3, thereby achieving a more convenient image-forming device by resolving the various problems in the conceivable configuration described above.

Since the paper 3 is discharged onto the discharge tray 27 with the image formation surface face down, the page order is maintained when printing a plurality of pages in succession.

Further, since the sheets of paper 3 are discharged in a direction toward the front side of the laser printer 1, on which side the cover 14 is provided, establishing this side as the front of the laser printer 1 facilitates operations for retrieving the paper 3 from the discharge tray 27 and for mounting and removing the process cartridges 10. In addition, the paper cassette 4 is removed from the main casing 2 through the same front side of the laser printer 1, thereby facilitating operations for loading the paper 3 in the paper cassette 4.

Further, the switchback conveying path 30 is configured to switch conveying directions of the paper 3 on the rear side of the fixing unit 23 (toward the side of the laser printer 1 opposite the side on which the cover 14 is provided). This configuration enables the discharge tray 27 to be provided deeper in the main casing 2 (farther rearward) than when the paper 3 is conveyed along a forward curving path from the fixing unit 23 and is discharged onto a tray. Accordingly, it is possible to reduce the amount that the discharge tray 27 protrudes on the front side of the laser printer 1 (the cover 14 side).

The paper-retracting section 30B functioning to receive the paper 3 during the switchback operation is disposed inside the main casing 2. This construction prevents the paper 3 from coming into contact with and potentially being soiled by objects outside the device during the switchback operation.

Discharging the paper 3 in a forward direction toward the surface on which the cover 14 is disposed is particularly convenient in laser printers 1 having an original-reading unit 31 that cannot be withdrawn for retrieving the paper 3 from the discharge tray 27.

Discharging the paper 3 in a forward direction toward the surface on which the cover 14 is disposed is particularly convenient in laser printers 1 having an original-reading unit that cannot be withdrawn for retrieving the paper 3 from the discharge tray 27.

The conveying velocity V2 may be set greater than the conveying velocity V1. That is, the conveying velocity of the paper 3 after the paper 3 has passed through the fixing unit 23 may be set greater than the conveying velocity prior to passing through the fixing unit 23. More specifically, the conveying velocity of the paper 3 after the entire part of the paper 3 has passed through the fixing unit 23 may be set greater than the conveying velocity before the entire part of the paper 3 has passed through the fixing unit 23. Accordingly, the time required for the paper 3 to be discharged onto the discharge tray 27 after the fixing operation can be reduced.

Further, by switching the conveying velocity of the reverse-conveying rollers 26 at the same time the conveying direction is switched, the configuration of the conveying mechanism can be simplified compared to a configuration for switching the conveying direction and conveying velocity at separate times. Here, the conveying mechanism includes a drive motor for producing a driving force, and a gear mechanism or the like for transmitting the driving force to the conveying rollers, for example.

Further, by satisfying Equation B described above, the first sheet 3A and second sheet 3B will not interfere with each other in the switchback operation during continuous printing. By minimizing the gap G between the first sheet 3A and second sheet 3B within the allowable range for satisfying the Equation (B), it is possible to shorten the time required for completing the entire printing operation.

While the invention has been described in detail with reference to the above aspect thereof, it would be apparent to those skilled in the art that various changes and modifications may be made therein without departing from the spirit of the invention.

For example, the following variations are possible.

(1) While the process cartridges 10 are arranged vertically in the above description, the process cartridges 10 may instead be arranged along a slant, for example, such that the lowest process cartridge 10 is closest to the front side, while the upper process cartridges 10 are shifted sequentially toward the rear side.

(2) While a paper-retracting section 30B for receiving sheets 3 during the switchback operation is provided inside the main casing 2 of the image-forming device in the above description, the switchback operation may be performed while exposing the sheets 3 outside the main casing 2 .

(3) While the conveying velocity of the sheets is increased in the above description upon switching the conveying direction of the sheets 3 (during the switchback operation), the conveying direction and conveying velocity of the sheet 3 may be switched separately.

For example, the conveying velocity may be increased directly after the sheet 3 has passed through the fixing unit 23. In other words, the conveying velocity may be increased directly after the entire part of the sheet 3 has passed through the fixing unit 23.

More specifically, in this modification, similarly to the above description, the sheet 3 is conveyed at the constant velocity V1 by the fixing unit 23. As the sheet 3 passes through the fixing unit 23, the advancing path 30A of the switchback conveying path 30 guides the leading edge of the sheet 3 rearward. It is noted that the distance along the advancing path 30A between the fixing unit 23 and the nip point N between the reverse-conveying rollers 26 is smaller than the length P of the sheet 3. Before the leading edge of the sheet 3 reaches the nip point N between the reverse-conveying rollers 26, the reverse-conveying rollers 26 are driven to rotate in a forward rotation for conveying the sheet 3 downward. At this time, the rotational speed of the reverse-conveying rollers 26 on the peripheral surfaces thereof is set to the velocity V1. Therefore, when the leading edge of the sheet 3 arrives at the nip point N, the sheet 3 maintains the velocity V1 while being conveyed into the paper-retracting section 30B. Thereafter, the trailing edge of the sheet 3 passes the fixing unit 23. In other words, the entire part of the sheet 3 has passed the fixing unit 23. Directly after the trailing edge of the sheet 3 passes the fixing unit 23, the rotational speed of the reverse-conveying rollers 26 on the peripheral surface thereof, that is, the conveying velocity of the sheet 3 in the downward direction, is changed to the conveying velocity V2 (mm/sec). Then, the trailing edge of the sheet 3 reaches the branch point B. After the trailing edge of the sheet 3 passes the branch point B and before the trailing edge of the sheet 3 reaches the nip point N of the reverse-conveying rollers 26, the reverse-conveying rollers 26 begin rotating in reverse. Consequently, the conveying direction of the sheet 3 is reversed. At this time, the rotational speed of the reverse-conveying rollers 26 on the peripheral surface thereof, that is, the conveying velocity of the sheet 3 in the reverse direction, is maintained at the conveying velocity V2 (mm/sec).

What is claimed is:

1. An image-forming device comprising:

a main device body;

a plurality of process cartridges detachably mounted in the main device body, the process cartridges being arranged in a row in the main device body when the process cartridges are mounted in the main device body, each process cartridge having an image-carrying member that transfers a developer image carried thereon to a sheet by opposing the sheet;

a fixing unit provided in the main device body and fixing the developer image to the sheet after the image has been transferred thereto;

a tray provided in the main device body and supporting the sheet after the developer image has been fixed thereon;

a switchback conveying path provided in the main device body and guiding the sheet from the fixing unit to the tray, while switching a conveying direction of the sheet; and a reverse conveying unit disposed in the main device body along the switchback conveying path and reversing the conveying direction of the sheet.

2. An image-forming device according to claim 1, wherein the process cartridges are stacked substantially vertically when the image-forming device is disposed in an orientation in which it is intended to be used.

3. An image-forming device according to claim 1, wherein the switchback conveying path guides the sheet onto the tray, with a surface of the sheet on which the developer image has been transferred facing downward.

4. An image-forming device according to claim 1, wherein the main device body has an opening formed in one side surface thereof via which the process cartridges can be inserted into or removed from the main device body, and a cover capable of opening and closing over the main device body to cover the opening;

wherein a discharge direction in which the sheet is discharged onto the tray is a direction toward the side surface of the main device body on which the cover is disposed.

5. An image-forming device according to claim 4, wherein the switchback conveying path has a switching position at which the conveying direction of the sheet changes, the switching position being located closer to a side surface of the main device body opposite the side surface on which the cover is disposed than the fixing unit.

6. An image-forming device according to claim 1, further comprising a sheet retracting section formed inside the main device body and receiving the sheet conveyed on the switchback conveying path when the conveying direction of the sheet is switched.

7. An image-forming device according to claim 1, further comprising an original-reading unit covering the tray and reading an image from an original document.

8. An image-forming device according to claim 7, wherein the original-reading unit is disposed above the tray to cover the tray from above when the image-forming device is disposed in an orientation in which it is intended to be used.

9. An image-forming device according to claim 8, wherein the original-reading unit is fixed to the main device body.

10. An image-forming device according to claim 1, wherein the reverse conveying unit conveys the sheet faster after the sheet passes through the fixing unit than before the sheet passes through the fixing unit.

11. An image-forming device according to claim 10, wherein the reverse conveying unit increases the conveying speed when reversing the conveying direction of the sheet.

12. An image-forming device according to claim 1, wherein a conveying velocity V1 conveying the sheet prior to switching conveying directions, a conveying velocity V2 conveying the sheet after switching conveying directions, and a gap G between a trailing edge of a preceding sheet prior to reversing the conveying direction and a leading edge of a succeeding sheet during a continuous printing operation satisfy the equation $V1 \cdot P/V2 \leqq G$, where P is a length of the sheets along the sheet conveying direction.

* * * * *